United States Patent [19]

Lapierre

[11] 4,272,912

[45] Jun. 16, 1981

[54] AIRPLANE MODEL WITH FLEXIBLE STRUT ASSEMBLY

[76] Inventor: Philippe Lapierre, 4, rue Pauly, 75014 Paris, France

[21] Appl. No.: 44,951

[22] Filed: Jun. 4, 1979

[30] Foreign Application Priority Data

Jun. 20, 1978 [FR] France ..... 78 18340

[51] Int. Cl.[3] ..... A63H 27/00

[52] U.S. Cl. ..... 46/79; 46/76 R; 244/38

[58] Field of Search ..... 46/79, 80, 81, 76 R, 46/77, 78; 244/38

[56] References Cited

U.S. PATENT DOCUMENTS

| | | | |
|---|---|---|---|
| 1,565,437 | 12/1925 | Greife | 46/81 X |
| 1,680,689 | 8/1928 | Miller | 46/79 |
| 2,066,649 | 1/1937 | Sabins | 244/38 |
| 2,275,094 | 3/1942 | Taylor | 46/79 |
| 3,204,368 | 9/1965 | Effinger, Jr. et al. | 46/79 X |
| 3,919,805 | 11/1975 | Stanzel | 46/77 X |

FOREIGN PATENT DOCUMENTS

| | | | |
|---|---|---|---|
| 458228 | 7/1950 | Italy | 46/80 |

*Primary Examiner*—Robert Peshock
*Assistant Examiner*—Mickey Yu
*Attorney, Agent, or Firm*—Lewis H. Eslinger

[57] ABSTRACT

An airplane model essentially comprising an assembly of struts, connecting the wings together and to the fuselage, and an elastic connecting strap for connecting the lower wings to the fuselage, which struts and connecting strap are flexible and resilient enough to allow the wings to pivot inside their plane, under the effect of a shock, and then to return them to their initial position. The invention relates in particular to the toy industry.

5 Claims, 11 Drawing Figures

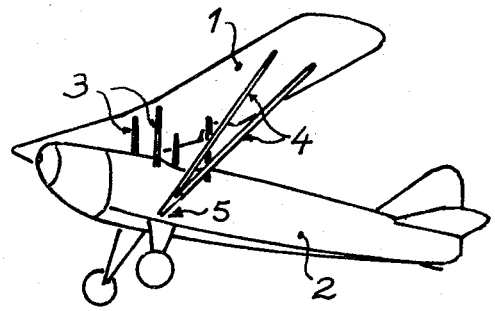
Fig. 1
Fig. 2
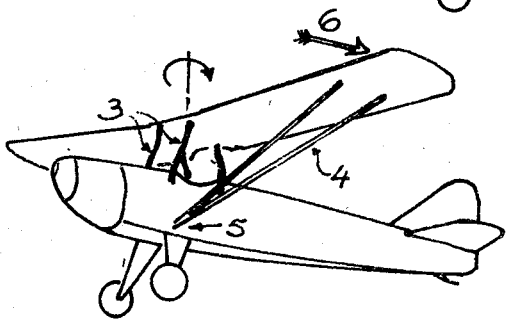
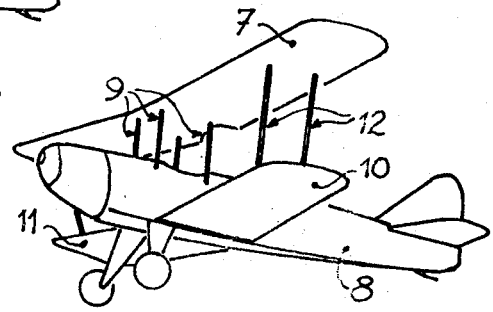
Fig. 3
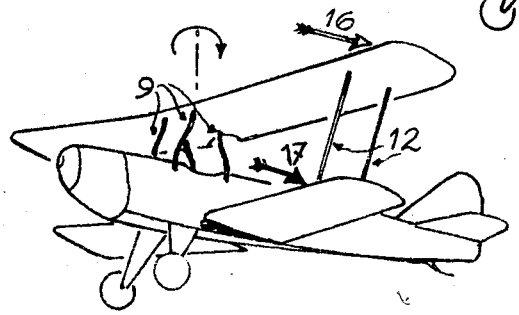
Fig. 4
Fig. 5
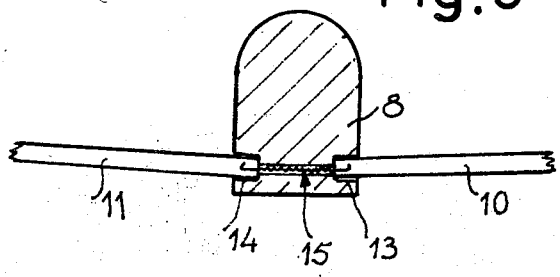

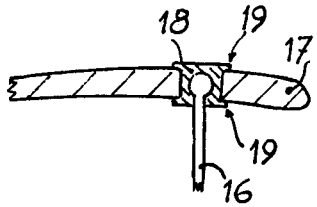
Fig. 6
Fig. 7
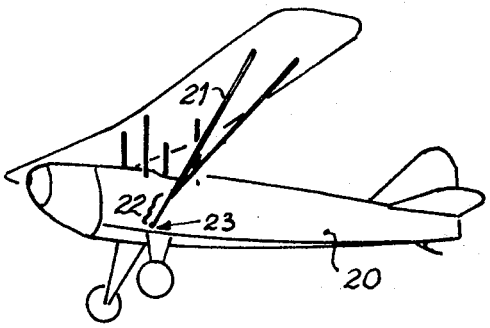
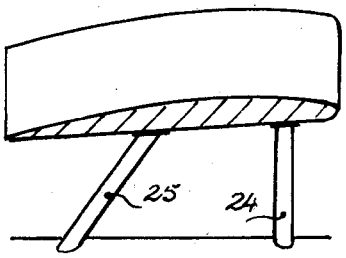
Fig. 8
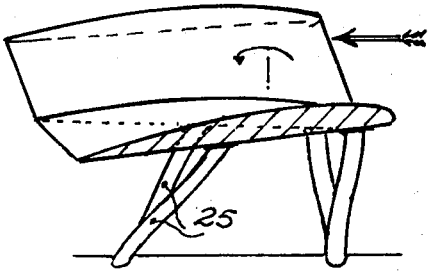
Fig. 9
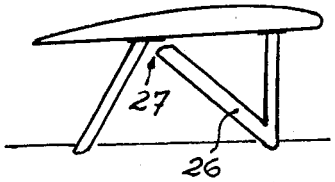
Fig. 10
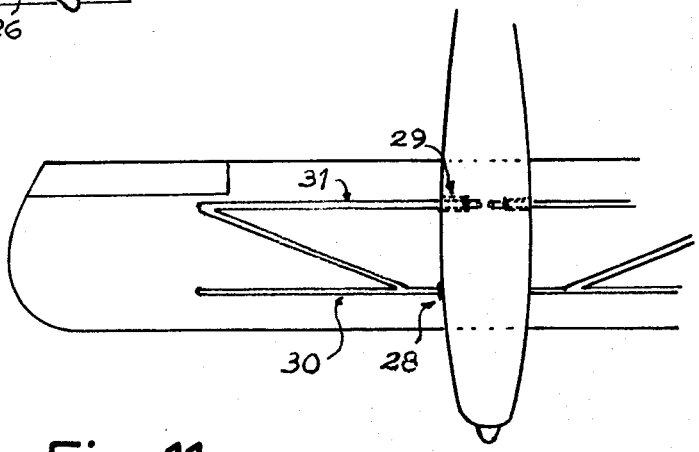
Fig. 11

AIRPLANE MODEL WITH FLEXIBLE STRUT ASSEMBLY

The present invention relates to air plane models and flying scale models.

In models of this type, which exceed a certain dimension, it is impossible to join rigidly the wings to the fuselage without causing such joint to break on rather rough landings.

The solution which is generally adopted consists in securing the wings to the fuselage by means of elastic straps the strength of which is selected to hold the wings in position during all the phases of the flight, but also to release them in case of shocks. Since the wings should be able to be readily disengaged, all the elements connecting them to the fuselage are also disconnectable and in particular the wing struts.

Although fulfilling the desired object, this solution has a number of disadvantages: it necessitates to reassemble the disconnected elements after each flight; it does not automatically ensure a good position of the wings, which may be only slightly moved out of place, but nevertheless strongly disturb the next flight; finally, it often requires a complex construction in the case of airplanes with strut braced wings and multiplanes.

Airplane models assembled according to the present invention have none of these disadvantages and combine an excellent resistance to impacts with a great simplicity of construction (since all the elements can simply be glued in position) and great flight reliability, the wings being automatically returned to the right position after any shock.

Airplane models assembled according to the invention comprise wings consisting of at least one strut-braced wing, with no direct contact with the fuselage, but secured thereto by an assembly of struts, the flexibility of which leaves it all freedom to pivot inside its plane under the effect of a shock or abnormal force; and returning it resiliently to its initial and normal flying position.

According to one embodiment of the invention, the model only comprises one strut-braced type wing secured to the fuselage, on the one hand by an assembly of struts, so-called centre section struts, flexible enough to bend and twist, and connecting the centre part of the wings to the top of the fuselage, and, on the other hand, by oblique struts connecting each right and left plane to the corresponding side of the fuselage and being secured thereto in a point about which they can slightly oscillate from the front to the back.

According to another embodiment of the invention, the model comprises a high wing of the strut-braced type secured to the fuselage by an assembly of so-called centre section struts, flexible enough to bend and to twist, connecting the central part of said wing to the top part of the fuselage, and a lower wing of which the right and left planes are secured to the corresponding planes of the upper wing by means of struts, flexible enough to bend and to twist, and of which the part closest to the fuselage is secured thereto by a means which leaves it free to oscillate resiliently inside its plane.

FIG. 1 is a perspective view of an embodiment of the present invention;

FIG. 2 is a view of FIG. 1 with an external force applied to the wing;

FIG. 3 is a perspective view of a second embodiment of the present invention;

FIG. 4 is a view of FIG. 3 with an external force applied to the wings;

FIG. 5 is a partial cross sectional view of FIG. 3, taken laterally across the fuselage and the lower wings;

FIG. 6 is a partial cross sectional view of an embodiment of a wing and struts connection;

FIG. 7 is a perspective view of a third embodiment of the present invention;

FIG. 8 is a partial cross sectional view of an embodiment of a wing struts and fuselage arrangement;

FIG. 9 is a view of FIG. 8 with an external force applied to the wing;

FIG. 10 is a partial view of another embodiment of a wing, struts and fuselage arrangement;

FIG. 11 is a partial bottom view of the airplane showing another embodiment of a wing, struts and fuselage arrangement.

The principles of embodiment and of operation of the airplane models according to the invention, will be better understood on referring to the accompanying drawings.

FIG. 1 shows a model with a strut-braced wing 1 joined to the fuselage 2 by means of four centre-section struts 3 fixed to the fuselage in their lower portion and to the wing in their top portion. These struts are flexible enough to bend and to twist. Oblique struts, on the other hand, connect the right and left planes to the lower part of the fuselage in a point 5 about which they can oscillate slightly.

FIG. 2 shows the same airplane model subjected to a shock in 6 under the effect of which the left end of the wing moves backwards. There follows a general movement of rotation of the wing, with elastic deformation of the centre-section struts 3 and backwards rotation of the struts 4 about their joining point 5. The energy then absorbed is proportional to the angle of rotation of the wing and to the reacting force obtained at the end portion of the wing. The damage-free absorption of the shocks which are known to occur on landing requires that a possibility be provided for an elastic rotation of several degrees, accompanied with a reaction force at the extreme end of the wing which is greater than the weight of the model. The elasticity of the strut assembly thereafter returns the wing to its normal position.

It is also noted that the arrangement of the centre-section struts gives a great stiffness in the vertical direction, thus ensuring that the incidence of the wing is kept, which is the major characteristic for a correct flight.

FIG. 3 shows a model of a biplane of which the upper wing 7 is joined to the fuselage 8 by means of four struts 9 as hereinabove described. The lower wings 10 and 11 are secured to the upper wing 7 by means of struts 12, flexible enough to bend and to twist but resistant to compression, so that the space between the two wings is kept constant as well as their relative incidence. These wings 10 and 11 are also maintained in position in the fuselage with a firm incidence, but they can rotate flexibly inside their plane, for example as shown in FIG. 5, by fitting with a slight clearance, into recesses 13 and 14 which adopt their outline and by being held in position therein by means of an elastic strap 15 crossing freely the fuselage, and joined to each end of the half-wings 10 and 11.

FIG. 4 shows the same model when subjected to a shock in 16 or 17. The force of the shock is absorbed without damages by a pivoting movement of the wings. The top wings pivot and return as described hereinabove. The lower wings pivot about their inside angle at the back for the wings moving backwards, and about their inside angle at the front for those moving forth, pulling on the elastic strap 15 which will return them to their initial position as soon as the force of the shock is absorbed.

Any differences in the backward movement of the top and lower wings are easily absorbed by the flexibility of the struts 12.

Considering that it is mainly the flexibility proper of the struts which is used to give mobility to the wings, said struts can in general be glued directly in position on the fuselage and on the wings, it is only the steps of the lower wings in a biplane which cannot be glued to the fuselage, hence a great simplicity of assembly.

On the contrary, if the intention is to take the plane to pieces for storage in a minimum volume of space, then the ends of the struts only need be just fitted into the wings. Such fitting should be able to withstand the normal stresses met during flight and on landing, but also allow the separation of the wings by a pulling action or any other suitable operation. FIG. 6 illustrates a possible embodiment wherein those ends of the struts 16 which fit into the wings 17 are swollen out, and come into resilient engagement into containers 18 which comprise a corresponding cavity and are made of rubber for example, and which are integral with wings 17 by glueing or by gripping between two flanges.

In the same way, oblique struts may be secured to the fuselage by means of an elastic swivel such as shown in FIG. 6 for easy dismantling and storage.

FIG. 7 shows a simpler embodiment, wherein the struts 21 are merely glued to the fuselage in 23, the freedom of oscillation being given by a flexible area provided in the struts.

An optimum flexibility of the centre-section struts is obtained when these are all vertical and parallel, they can also be two in number or more, positioned in tandem, or in a triangle or a rectangle, indifferently.

The accurate assembly of airplane models however can often necessitate the adoption of a different arrangement.

FIG. 8 shows the frequent case of centre sections whose front struts 24 are vertical and back struts 25 rather steeply inclined. FIG. 9 shows the central part of a wing mounted on such a centre section and after pivoting under the effect of a shock at its left end. The inclination of the rear struts causes that part of the wing to twist in corkscrew manner, so that said part of the wing should be made flexible so as to withstand this twisting without breaking. The rest of the wing which needs to recover the normal incidence in vertical relation to the oblique struts is subjected to a reverse twisting, which should also be taken into account in the design of the wing.

FIG. 10 shows another type of centre-section often used, and N-shaped, which would be too rigid to bend and to allow the desired movements. It suffices then to break the diagonal strut 26, for example in 27, which is a not very visible area, to ensure both the accurate aspect of the N-shaped centre section and the centre-section in II.

FIG. 11 shows a possible solution to a similar problem of excessive rigidity in the oblique struts, this time when said struts are connected to the fuselage in two points 28 and 29. Then it suffices to produce the front strut 30 as shown in FIG. 7, for example, and to leave the rear strut free to slide in a recess provided to this effect in the fuselage.

The present invention can be applied to all types of airplane flying models, whether motorized or not, and to all types of constructions: canvas mounted on wood, or plastics. But it is especially applicable to the models produced in expanded plastics in which the flexible struts can easily be fitted or glued.

The solidity of the connections between the struts and the other elements of the model (wings and fuselage) is increased by increasing the joining and glueing surface between these elements, for example by the struts ending in wider spatula-shaped surfaces, which fit into slots provided in the fuselage and the wings, or by connecting the feet of the struts two by two, by means of "roots" which, at assembly, are fitted into slots in the wings and in the fuselage.

The struts may be produced differently, for example of cane of small diameter, or in polyamide of small cross-section.

By way of example, the optimal dimensions for a biplane with a span of 50 cm, made of an expanded polystyrene of density 0.035 and weighing 80 grams in flight state: the struts are polyamide of two millimeters in diameter. The average length of the centre-section struts is 40 millimeters, and that of the four struts in the wing gap is of 85 millimeters. The centre section struts not being parallel, but forming an angle of 30° in front view and of 20° in cross-sectional view, it is necessary for the central part of the wing to be flexible enough to bend, and this is obtained if its thickness is limited to about 5 millimeters.

In this very precise case, a force of 200 grams applied from the front towards the back at the end of a top wing makes it go backwards elastically by about 18 millimeters, i.e. a movement of rotation of about 4°, the elastic deformations being mainly localized in the assembly formed by the four centre-section struts and the centre of the wing.

It is regretfully not possible either to give here all the dimensions of the optimal struts which can equip all the airplane models, their variety being innumerable, or to give a mathematical formula thereof. But anyone skilled in the art can easily establish, from the example of figures given hereinabove, what cross-sections and lengths are suitable for the different sizes and weights of airplane models, bearing in mind of course that the cross-sections of the struts should increase or be reduced with the other dimensions (span and weight).

What is claimed is:

1. An airplane model, comprising:

a fuselage;

a wing assembly including an upper wing comprised of two half-wing sections; and strut brace means including a plurality of center section struts for directly securing said upper wing to said fuselage in a substantially fixed relationship which is maintained during repeated use of the model, each said strut being made from a resilient material whereby said strut brace means acts to return said upper wing to said fixed relationship with said fuselage upon the occurrence of forces applied to the wing assembly which result in movement of said upper wing with respect to said fuselage and said strut brace means further including an oblique strut assembly for connecting each half-wing section to the fuselage with each oblique strut assembly being connected to at least a first point on said fuselage in one of a flexible and hinged manner and to at least a second point on said fuselage in a sliding manner.

2. The model according to claim 1; in which the upper wing is sufficiently flexible to twist between the points of attachment of the oblique struts on the upper wing.

3. An airplane model, comprising:

a fuselage including a recessed section on both sides thereof;

a wing assembly including an upper wing and a lower wing comprised of two lower half-wing sections, each adapted to fit at least partially within a respective one of said recessed sections;

strut brace means including a plurality of center section struts for directly securing said upper wing to said fuselage in a substantially fixed relationship which is maintained during repeated use of the model, each said strut being made from a resilient material whereby said strut brace means acts to return said upper wing to said fixed relationship with said fuselage upon the occurrence of forces applied to the wing assembly which result in movement of said upper wing with respect to said fuselage; and resilient means for maintaining said half-wing sections within said respective recessed sections in a substantially fixed relationship to said fuselage whereby said resilient means acts to return said half-wing sections to said fixed relationship with said fuselage upon the occurrence of forces applied to said half-wing sections which result in movement of said half-wing sections with respect to said fuselage.

4. The model according to claim 3; in which said upper wing is comprised of two half-wing sections and said strut brace means further comprises wing-gap struts made from a flexible material of small cross-section for connecting the upper half-wing sections to the respective lower half-wing sections.

5. The model according to claim 4; in which the upper wing is sufficiently flexible to twist between the points of attachment of the wing-gap struts on the upper wing.

* * * * *